US005174228A

United States Patent [19]

Grimnes

[11] Patent Number: 5,174,228

[45] Date of Patent: Dec. 29, 1992

[54] NON-WOVEN REINFORCEMENT STRUCTURE

[75] Inventor: Martin S. Grimnes, Brunswick, Me.

[73] Assignee: Brunswick Technologies, Inc., Brunswick, Me.

[21] Appl. No.: 632,036

[22] Filed: Dec. 21, 1990

[51] Int. Cl.[5] ..... B32B 7/08; D04H 5/08; D05B 23/00

[52] U.S. Cl. ..... 112/262.1; 28/104; 112/2; 112/420; 156/93; 156/519; 428/102

[58] Field of Search ..... 112/262.1

[56] References Cited

U.S. PATENT DOCUMENTS 3,614,936 10/1971 Phillips ..... 112/420

*Primary Examiner*—James C. Cannon

*Attorney, Agent, or Firm*—Fish & Richardson

[57] ABSTRACT

Non-continuous fiber reinforcements for resinous material having a layer of chopped strands, evenly distributed in random orientations and a confinement layer extending over and in intimate contact with layer of chopped strands. Rows of stitching are provided. individual stitches in the rows attach the confinement layer and the chopped strands.

5 Claims, 5 Drawing Sheets

NON-WOVEN REINFORCEMENT STRUCTURE

BACKGROUND OF THE INVENTION

The invention relates to reinforced plastic structures.

Reinforcement structures for plastics used, e.g., in the manufacture of boat hulls, automobile fenders, and bathroom fixtures generally may include structural reinforcements formed of continuous strands of glass, often referred to as continuous strand mats, and non-structural reinforcements formed of chopped strands of glass, bonded together by an adhesive, e.g., a powder or emulsion binder, often referred to as chopped strand mats.

Structural reinforced plastics are typically formed from the continuous mats by closed mold processing which involves laying the mat in a cavity formed between two molds and injecting a resin system into the cavity. Non-structural reinforced plastics are usually formed by open mold processing which involves applying resin to the mat placed over a mold surface and curing it to form the finished product. Typically, in both closed and open mold processing, a binder, e.g., hot melt polyester powder binder or emulsion binder, holds the strands together when the mat is laid in the molds and then dissolves upon contact with the resin.

SUMMARY OF THE INVENTION

An object of the invention is to provide non-structural reinforcement mats of improved design that provide superior properties. Other objects are to provide enhanced aesthetic and structural properties when the mats are incorporated into finished products produced by open and closed mold processes as well as other processing schemes, and to further simplify such processing The reinforcement mats according to the invention include a confinement layer such as a weft or non-woven fabric extending across the width of the chopped strand mat that maintains uniform positioning of the chopped strands during processing and provides advantageous properties to the mat as well as to the finished products, such as improved strength and flexibility along the 90° direction.

In one aspect, the invention features a non-continuous fiber plastic reinforcement, having a layer of chopped strands, evenly distributed in random orientations, a confinement layer extending over and in intimate contact with the layer of chopped strands, and rows of stitching, individual stitches in the rows attaching the confinement layer and the chopped strands. The chopped strands are preferably formed of glass or polyester and are either of uniform length or vary in length from one to eight inches. The confinement layer is a weft of individual threads extending in a direction generally in a zig-zag pattern and at an angle to the extension of the weft threads. In addition, a sheet of non-woven material is located adjacent to at least one side or both sides of the layer of chopped strands, the sheet being stitched together with the weft layer and the chopped strands. The non-woven material can be of the type that melts under low heat. Further, the reinforcement is in a preformed shape to which resin may be applied, the shape being provided by tabbing or stitching. The confinement layer can also be a sheet of non-woven material located adjacent to at least one side or both sides of the layer of chopped strands, the sheet being stitched together with the chopped strands. The reinforcement may further include a thermoplastic binder, e.g., a hot melt powder or spray adhesive binder, applied to the layer of chopped strands.

In another aspect, the invention features an apparatus for producing a non-continuous plastic reinforcement, including a cutter for applying chopped strands in random orientation, a confinement means for confinement of the chopped strands by extending a confinement layer over and in intimate contact with the strands, and a stitching machine being adapted to sew rows of stitching yarn through the confinement layer and the chopped strands. A slider plate is located at the end of the belt, the plate being angled downward toward the stitching machine, which may be of Malimo design or may be a weft insertion or similar machine. In addition, the apparatus includes a dispenser reel adapted to feed a sheet of non-woven material onto at least one surface of the chopped strands, which material softens under heat. The apparatus may also include a binder applicator located between the cutter and press roller adapted to apply a thermoplastic binder material to the chopped strands. In one embodiment, the confinement means is a weft carriage which is located perpendicular to the conveyor belt and adapted to move across the belt to lay a series of weft strands over the chopped strands. In another embodiment, the confinement means is a roller for a non-woven material, for confinement of the strands with the non-woven material.

In another aspect, the invention features a method of producing a non-structural plastic reinforcement by cutting continuous strands to provide a layer of randomly distributed chopped strands, confining the strands by laying a confinement layer, e.g., a weft layer or non-woven material layer, over and in intimate contact with the chopped strands to maintain the placement of the chopped strands, and stitching the confinement layer together with the chopped strands. The weft maintains placement of the strands as they move over a downward slope towards a stitching machine. The stitching may be that of a Malimo stitching machine. In cases where the confinement layer is a layer of non-woven material, a sheet of non-woven material is laid on at least one side of the layer of chopped strands, and is stitched together with the weft strands and the chopped strands. In addition, the method can include applying a thermoplastic binder to the chopped strands before stitching. In another embodiment, the method calls for laying a sheet of non-woven material on at least one side of the chopped strands and applying hydro-entangling to attach the chopped strands and the sheet. Two other embodiments call for a non-woven material which is softenable and includes preforming the reinforcement, and for preforming the reinforcement by softening the binder. A further embodiment calls for forming the mat by hydro-entanglement.

Other advantages and features will become clear from the drawings and the following description of a presently preferred embodiment, and from the claims.

DESCRIPTION OF THE PREFERRED EMBODIMENT

Referring first to the drawings.

Figure 1:
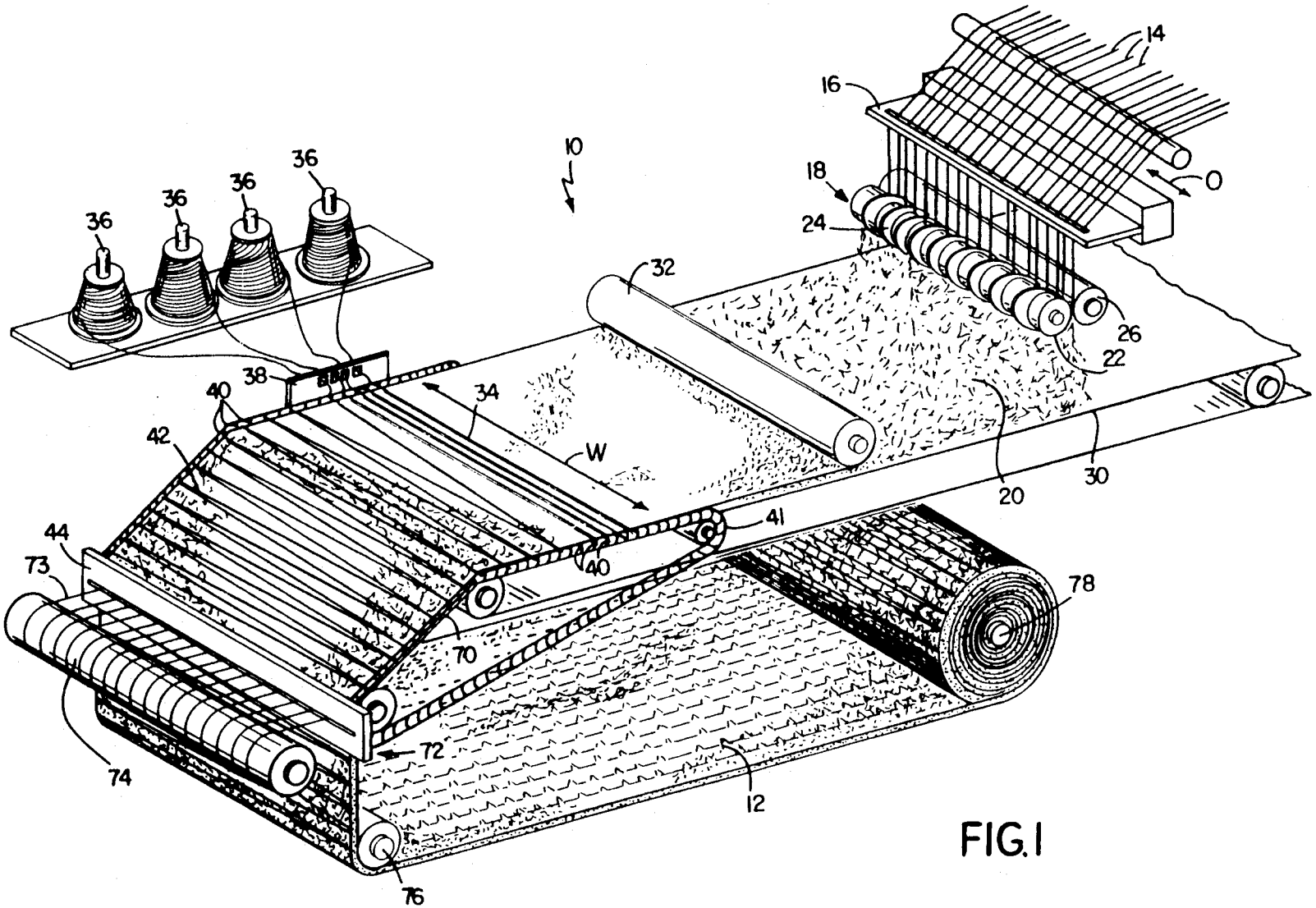
FIG. 1 is a perspective view of an apparatus for producing a non-woven reinforcement according to the invention.
Figure 2:
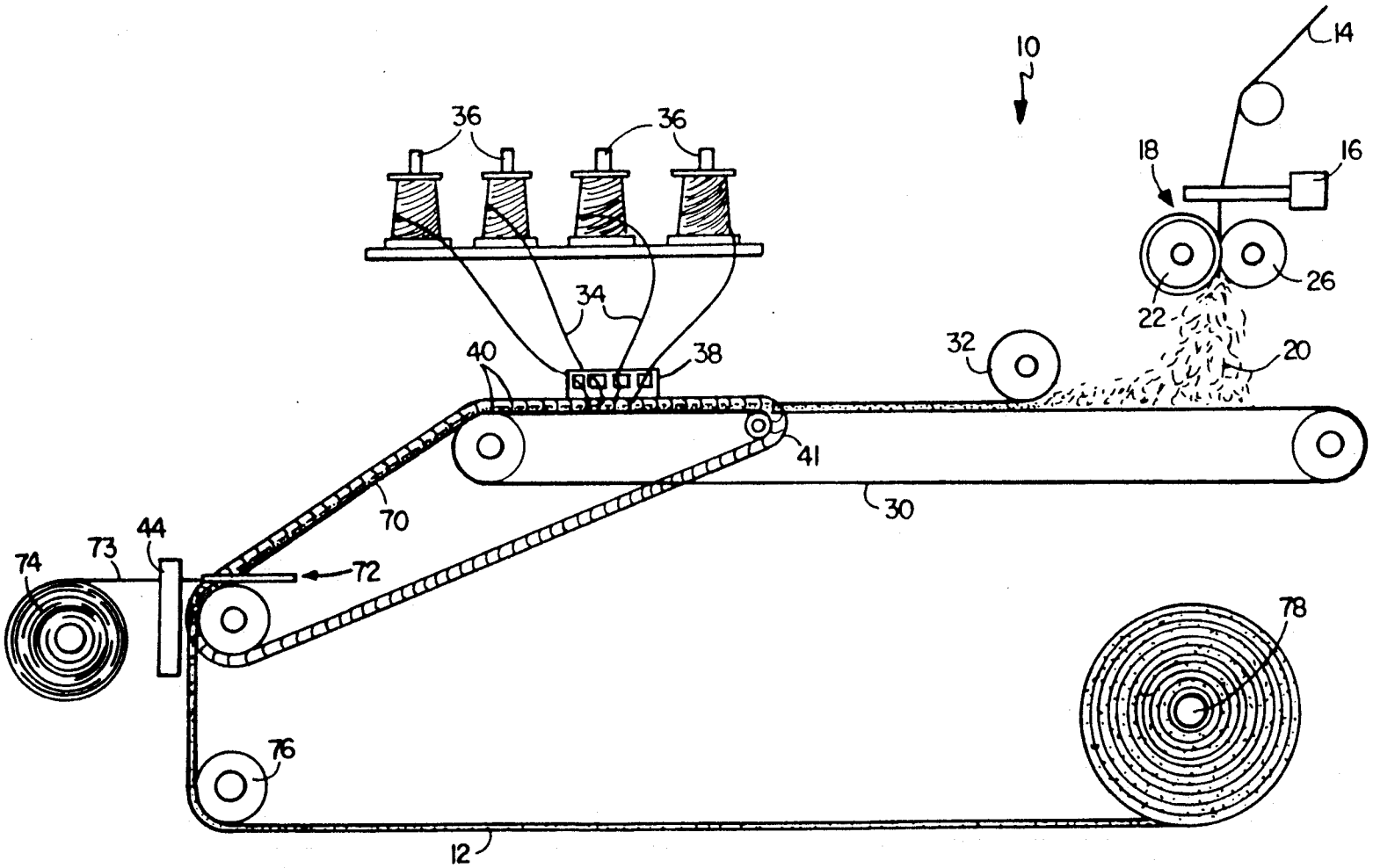
FIG. 2 is a somewhat diagrammatic side view of the apparatus shown in FIG. 1.

Referring to FIGS. 1 and 2, an apparatus 10 for producing a chopped strand mat 12 is shown. Continuous strands 14, formed, e.g., of glass, polyester or other synthetic material, are fed through an oscillating board 16 which separates the strands before they enter a cutter 18. Each continuous strand 14 consists of multiple fine strands that split apart when cut, thereby providing a fine layer of chopped strands 20. A pound of the single strand, for example, is approximately 200 yards in length, and each chopped strand separates into approximately 30 smaller strands to increase the coverage over the mat. The side to side oscillation (arrows 0) of the board 16, approximately one to two inches in either direction, further helps to distribute the chopped strands 20 evenly and minimize non-uniform knifewear.

The cutter 18 includes a roller 22 approximately 6–8 inches in diameter which has blades 24 circumferentially spaced thereabout. As the roller 22 rotates, the blades 24 contact a second roller 26 formed of hardened rubber and cut the continuous strands 14 as they pass between the rollers. The number and spacing of the blades 24 controls the length of the chopped strands 20, the preferred length being between 1 and 8 inches. Longer chopped strands tend to provide higher structural properties. For example, chopped strands 3 inches long provide more strength than those 2 inches long, and strands 4 inches long provide more strength than those 3 inches long. In many embodiments the increase in strength levels off at approximately 6 inches.

Once cut, the chopped strands 20 fall directly onto a conveyor belt 30 located approximately 12 to 18 inches below the cutter 18. The distance between the cutter 18 and the belt 30 is selected to allow enough room for the chopped strands 20 to randomly orient themselves as they fall. The belt 30 moves the chopped strands 20 continuously forward toward a stitching machine 44, e.g., of conventional Malimo design, e.g., type 14016, (Chima, Inc. Reading, Pa.), or a standard weft insertion machine. As they move forward, the chopped strands 20 pass under a press roller 32 which compresses the chopped strands to make the surface uniform, e.g., by flattening any strands that may be sticking up, so that a weft carriage 38 can pass clearly over the chopped strands.

After the chopped strands 20 pass under the press roller 32, a series of weft strands 34, formed, e.g., of polyester, glass, or other fibers, are laid over the chopped strands. The weft strands 34 are fed from spools 36 and threaded through the weft carriage 38 which is located perpendicular to the belt 30. The weft carriage passes back and forth (arrows W) over the chopped strands 20, looping the weft strands 34 into weft hooks 40 attached to conveyors 41 on either side of the moving belt 30 which move parallel to the belt, thereby laying a weft 42 over the chopped strands. The weft 42 is formed in a zig-zag pattern over the chopped strands 20, owing to the forward motion of the belt 30 and conveyors 41 at the same time the weft 42 is being laid. By using a conventional weft insertion device, e.g., as manufactured by Liba or Mayer, a weft can be formed at a 90° angle to the selvedge of the finished mat.

Once the weft 42 is laid, the belt 30 carries the chopped strands 20 to a slider plate 70 which slopes downward at approximately a 45° angle into a stitching area 72. Using a conventional Malimo process, stitching yarn 73, formed, e.g., of glass or polyester, is fed from a reel 74 and stitched in a tricot or chain pattern, or a combination tricot and chain pattern (shown in FIG. 6), through the weft 42 and chopped strands 20. Finally, after passing through the stitching machine 44, the finished chopped mat 12 is fed down and around a kick off wheel 76 that disengages the weft 42 from the weft hooks 40, and the mat is taken up on a roll-up device 78.

The weft strand 42 provides important advantages that are particular features of the present invention. The weft 42 confines the chopped strands 20 as they enter the Malimo stitching machine 44. In particular, the weft 42 prevents the chopped strands 20 from sliding out of place during the descent on the slider plate 70, thus avoiding redistribution of the strands that could lead to unacceptable variations in the uniformity and density of the strands without the use of a binder. The weft 42 also provides strength and controlled elasticity to the chopped mat 12 in the direction perpendicular to the stitching done by the stitching machine 44. The non-structural reinforcement incorporating the weft also enables improved final products that have enhanced strength in the weft direction, without sacrificing flexibility.

The stitched chopped mat 12 of FIGS. 1 and 2 provides elasticity in both its lengthwise and widthwise directions. The mat can also be used in closed-mold processing or in open-mold processing in each line with or without a binder. The weft 42 and stitching prevent the chopped strands 20 from washing to one end of the closed mold when resin is injected which could in some cases produce undesirable weak spots in the finished product. The weft also prevents the strands from lofting upward from air flow underneath the fibers which can distort the shape of the finished product.

Products manufactured with binders that are designed to degrade when exposed to a resin system are thus not precluded from any use where resin is applied prior to the final positioning or "layup" of the mat, i.e., in closed mold processing or in pre-impregnation of a mat prior to layup since the weft maintains the fiber positioning and distribution when resin is applied and at the same time remains workable for layup.

In addition, the weft 42 as well as the stitching yarn 73 aid in holding the mat down, thereby eliminating the risk of introducing air into the chopped strands after they have been wetted. The mat is by nature less spongy than, for example, a continuous strand mat and is not limited primarily to use in a closed mold rather than in an open mold. If used in an open mold, a continuous strand mat has a tendency to expand back to its original density after being wetted with resin and allows air into the laminate. Further, particularly in the embodiments without a binder, the chopped mat 12 is wetted with resin quickly because without a binder the mat is more absorbent. The elimination of a binder also reduces the effects of blistering and surface porosity in the finished product and increases conformability. In open mold processing, the chopped mat 12 can be scraped with a squeegee tool to remove excess resin without a danger of distorting the fiber distribution, i.e., the chopped strands stay in place and are not scraped together or apart, thereby maintaining uniform fiber distribution.

The longitudinal distance (in the 0° direction, i.e., direction of conveyor motion) between adjacent lengths of the weft material extending across the strands (the 90° direction) depends on the desired proportions of the finished product. For example, smaller distances between weft lengths increase both dry and wet tensile strength in the direction of the weft. For a typical chopped mat of approximately 18 ounces per square yard and having weft strands of 100–300 denier of polyester yarn, the distance between the weft strands varies from ¼ inch to 1 inch. Such a product with tricot Malimo stitching provides strength in the direction of the weft, yet is still sufficiently flexible to be used in, for example, a fiberglass bumper. Furthermore, the thickness of the weft can be controlled by controlling tension of the weft and the number and tension of stitches at the stitching stage to control the thickness of the finished product.

Figure 3:
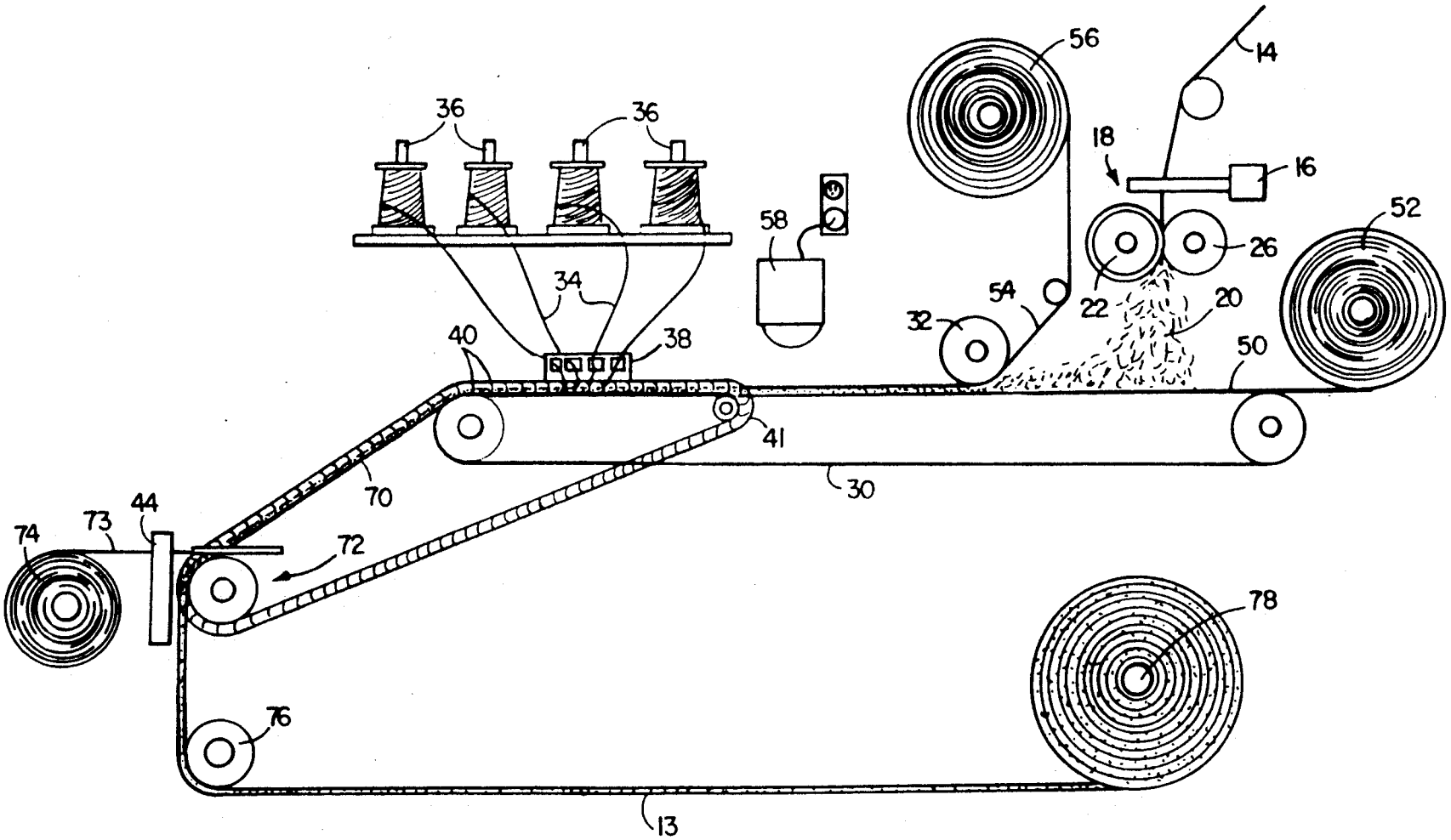
FIG. 3 is a similar view of the apparatus shown in FIGS. 1 and 2, further including a non-woven cloth which is incorporated into the reinforcement.

Referring to FIG. 3, there is shown an alternative embodiment of the invention which is particularly useful for open-mold processing because the mat has a smooth surface attractive for use in such products as automotive parts. The chopped strands 20 fall onto a continuous web 50 of non-woven material, e.g., 100% polyester wet lay (¾ ounce/square yard) as manufactured by International Paper Co., fed from a reel 52 onto the conveyor belt 30. A second sheet 54 of non-woven material 54 fed from a second reel 56 and is laid on top of the chopped strands 20. The belt 30 moves the sandwich of non-woven webs 50,54 and chopped strands 20 continuously forward toward the stitching machine 44. In so doing, the non-woven webs 50,54 and the chopped strands 20 pass under the press roller 32 which compresses the chopped strands to make the surface uniform. In alternate embodiments, the web 54 can be laid after the weft, or the weft can be omitted, with the web 54 functioning to hold the chopped strands in place and provide advantageous proportion in the final product. The non-woven material is a substantially planar, tissue-like material that is formed of short fibers and may be placed in direct contact with the chopped fibers to provide a confinement. The properties of the non-woven material provide strength and flexibility in the 90° direction in the final product. The mat 13 is then fed over the slider plate 70 into stitching area 72 and rolled up on take up device 78.

An advantage of using non-woven material with the chopped mat is the ability to preform the mats to facilitate production for injection molding. One or both of the non-woven webs can be made from fibers (such as polyester fibers) that soften or melt when sufficient heat is applied, e.g., by a heat lamp 58, and retain the shape of a temporary mold once the heat is removed.

Another advantage of the non-woven material is reduced processing time. When preformed as described above, the chopped mat does not have to be draped, i.e., made to conform to a mold shape, before resin is injected. Nor is there any need to wet the chopped mat with resin to dissolve binders used in other techniques. Instead, the chopped mat can be preformed to a particular shape, e.g., that of a fender or hood, by removing it from the take up device, cutting it into a particular shape and then tabbing and stitching the mat together, e.g., as a shirt or dress is stitched together in the apparel industry, to give it form before resin is applied. In addition, the non-woven surface provides a uniform surface or "print stop", which is desireable in preventing the chopped strands from appearing under painted or lacquered resin in the finished product.

Figure 4:
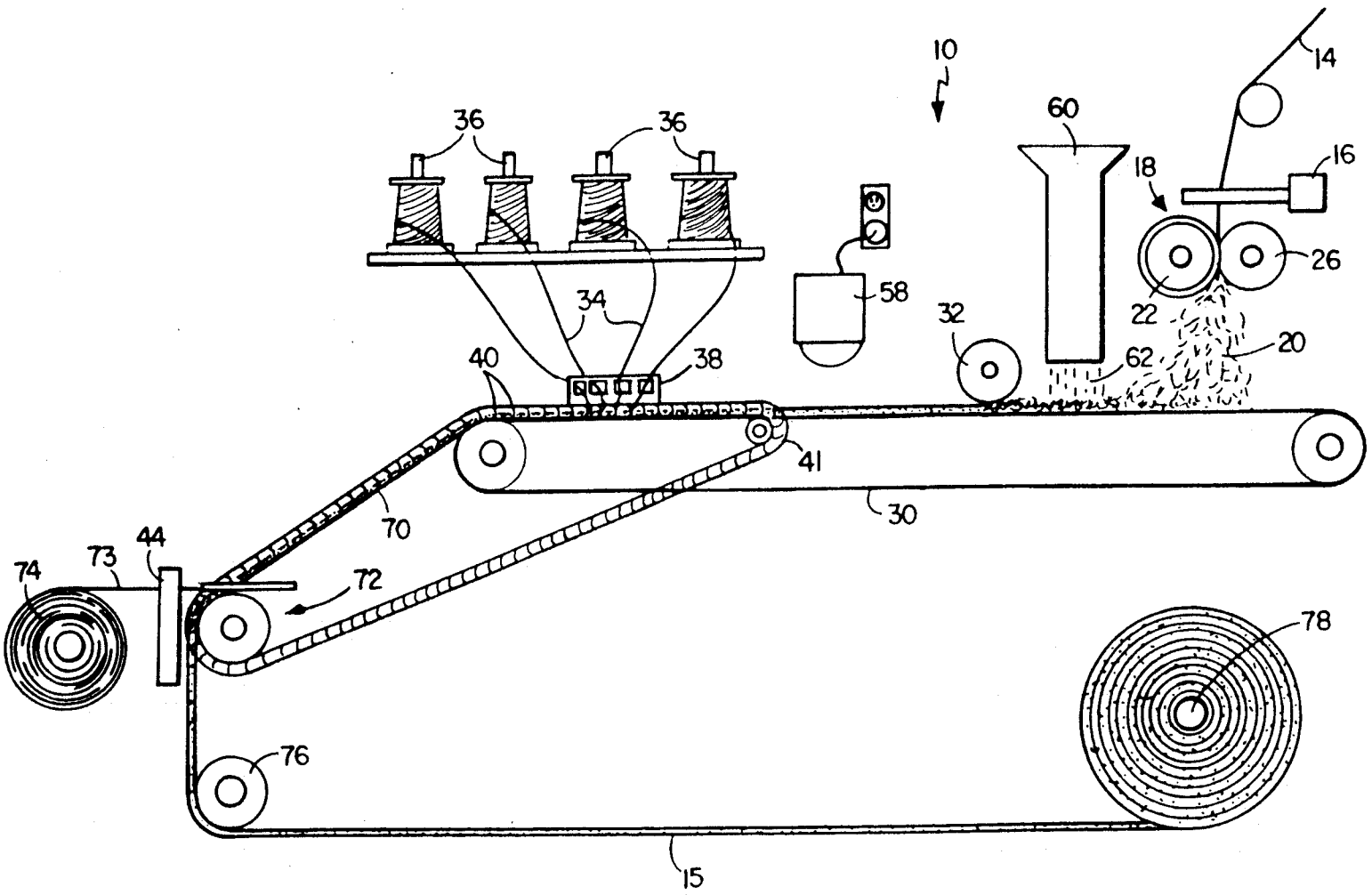
FIG. 4 is a similar view of the apparatus shown in FIGS. 1 and 2, further including a binder applicator which applies a thermoset binder to the reinforcement.

Referring to FIG. 4, in another embodiment of the invention, a thermoplastic binder applicator 60 is positioned between the cutter 18 and the press roller 32. The chopped strands 20 fall directly onto the conveyor belt 30 and a thermoplastic binder 62, such as a spray or powder adhesive, e.g., Eastman Chemical's polyester powder, is applied to the strands before they pass under the press roller 32. After the chopped strands 20 pass under the press roller 32, the heat lamp 58 melts the binder 62. The weft 42 is then laid over the chopped strands 20 and stitched as described above in connection with FIGS. 1 and 2.

The mat 15 having thermoplastic binder applied to it can be preformed by removing it from the take up device 78. In this way, the mat can be molded without wetting. Also, because the chopped mat is reinforced with the weft feature, it can be heated and molded without danger of the chopped strands falling out of place. The binder 62 gives permanent shape to the mat after heat is applied to the mold but generally may not contribute to mat strength. The amount of binder used may be independent of the mat and does not inhibit the ability to conform the mat to a mold.

Figure 5:
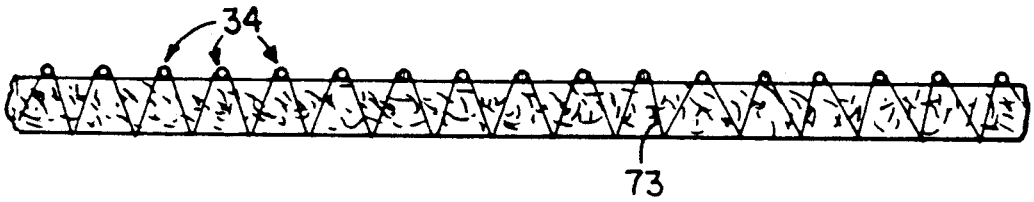
FIGS. 5 and 6 are side and top views, respectively, partly in cross section, of the reinforcement of the invention, including the weft structure and the stitching pattern.
Figure 6:
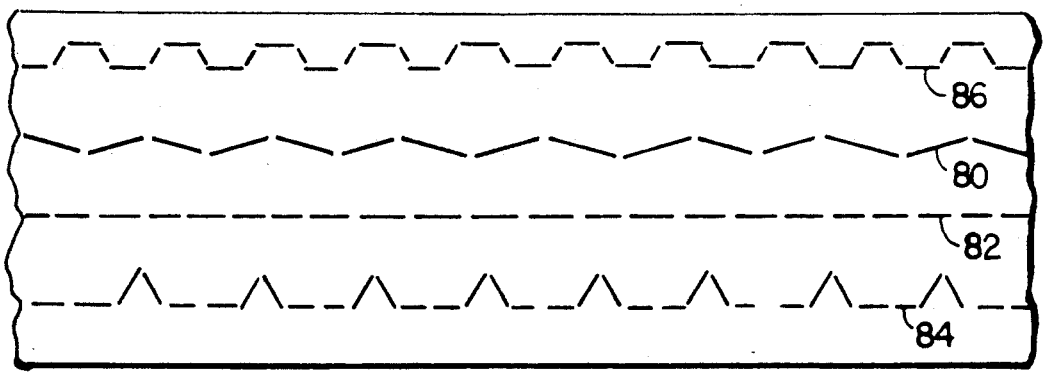

Referring to FIG. 5, an element of finished chopped mat 12 formed according to the process in FIG. 1 is shown in cross section. The weft lengths 34 are laid on top of the chopped strands 20 and the yarn 73 is stitched over the weft strands and through the chopped strands. A top view of the chopped mat 12, provided in FIG. 6, shows a combination of possible stitching patterns used, including tricot pattern 80, chain pattern 82, and combination tricot and chain patterns 84,86. These patterns are incorporated into the Malimo stitching machine 44. The density of the stitching is related to the requirements of dry tensile strength, i.e., the stitching provides strength in the lengthwise direction of the mat 12, while the weft 42 provides strength in the widthwise direction of the mat.

It will be appreciated that variations of the reinforcements described above are possible. For example, the chopped strand mat of FIG. 3 having non-woven material thereon can also be made using a hydro-entanglement process instead of stitching. That is, the non-woven material can be physically attached to the chopped mat by subjecting the non-woven sheets and chopped mat to high energy water jets, e.g., at 1500 psi, which carry the fibers of the non-woven material through the chopped mat, thereby attaching the two, e.g., as is done in spun laced products.

EXAMPLES

The following may be used to form a reinforcement as discussed above.

| EXAMPLE 1 | |
|---|---|
| Machine: | 14016 MALIMO |
| Gauge: | 3½ |
| Stitching Yarn: | 150 denier textured polyester |
| Stitches per inch: | 7 |
| Type of stitch: | tricot |
| Weft yarn: | 150 denier POY polyester |
| Weft yarns per inch: | 4 |
| Chopped mat fiber: | Certainteed type 227 glass (207 yards/pound) |
| Total weight of mat: | 18 ounces/sq. yard |

-continued

| EXAMPLE 2 | |
|---|---|
| Machine: | 14016 MALIMO |
| Gauge: | 3½ |
| Stitching Yarn: | 150 denier textured polyester |
| Stitches per inch: | 4½ |
| Type of stitch: | tricot |
| Non-woven fabric type: | wetlay |
| Non-woven fabric fiber: | polyester |
| Non-woven fabric weight: | ¾ ounces/sq. yard |
| Weft yarns per inch: | 4 |
| Chopped mat fiber: | Certainteed type 227 glass (207 yards/pound) |
| Total weight of mat: | 27 ounces/sq. yard |

Further embodiments are within the following claims.

I claim:

1. A method of producing a non-structural plastic reinforcement comprising the steps of:

providing an apparatus for producing a chopped strand mat comprising a cutter, a conveyor moving in a machine direction, and a stitching machine;

feeding continuous strands of fibers to the cutter;

cutting the continuous strands of fibers into chopped strands in a manner to provide a uniform layer of randomly distributed chopped strands upon the moving conveyor, the uniform layer of randomly distributed chopped strands having a predetermined, cross-machine dimension;

advancing the uniform layer of randomly distributed chopped strands upon the moving conveyor in the machine direction;

confining the chopped strands in a cross-machine direction by laying a confinement layer over and in intimate contact with said chopped strands, the confinement layer having a substantial cross-machine dimension of the order of said predetermined cross-machine dimension, to maintain the placement of the chopped strands int he layer of randomly distributed chopped strands; and stitching the confinement layer together with the chopped strands to confine the chopped strands in machine direction.

2. The method of claim 1 wherein said confining step comprises applying a weft layer of yarns.

3. The method of claim 2 wherein said confining step comprises applying a continuous web of material.

4. The method of claim 3 wherein said confining step comprises applying the continuous web of material upon the weft layer of yarns.

5. The method of claim 3 wherein said confining step comprises applying the weft layer of yarns upon the continuous web of material.

* * * * *